United States Patent [19]

Parker

[11] 4,237,795

[45] Dec. 9, 1980

[54] DUAL HEIGHT TABLE

[75] Inventor: Wayland B. Parker, South Boston, Va.

[73] Assignee: Daystrom Furniture, Inc., South Boston, Va.

[21] Appl. No.: 953,207

[22] Filed: Oct. 20, 1978

[51] Int. Cl.[3] ..... A47B 3/08

[52] U.S. Cl. ..... 108/12; 108/19

[58] Field of Search ..... 108/12, 11, 19, 35, 108/36, 116, 117, 132

[56] References Cited

U.S. PATENT DOCUMENTS

| | | | |
|---|---|---|---|
| 2,329,213 | 9/1943 | Neutra et al. | 108/19 |
| 2,581,658 | 1/1952 | Hicks | 108/19 |
| 2,843,437 | 7/1958 | Dorsey et al. | 108/19 |
| 3,087,442 | 4/1963 | Berlinger | 108/19 |
| 3,783,799 | 1/1974 | Dupuis | 108/19 |
| 4,706,413 | 8/1978 | Hoaglund | 108/12 |

FOREIGN PATENT DOCUMENTS

| | | | |
|---|---|---|---|
| 880030 | 3/1943 | France | 108/12 |

*Primary Examiner*—Roy D. Frazier
*Assistant Examiner*—Peter A. Aschenbrenner
*Attorney, Agent, or Firm*—Fitch, Even, Takin, Flannery & Welsh

[57] ABSTRACT

A table selectively adjustable to two heights on L-shaped leg members which are pivoted to the table top at corresponding distal ends of the leg members.

4 Claims, 5 Drawing Figures

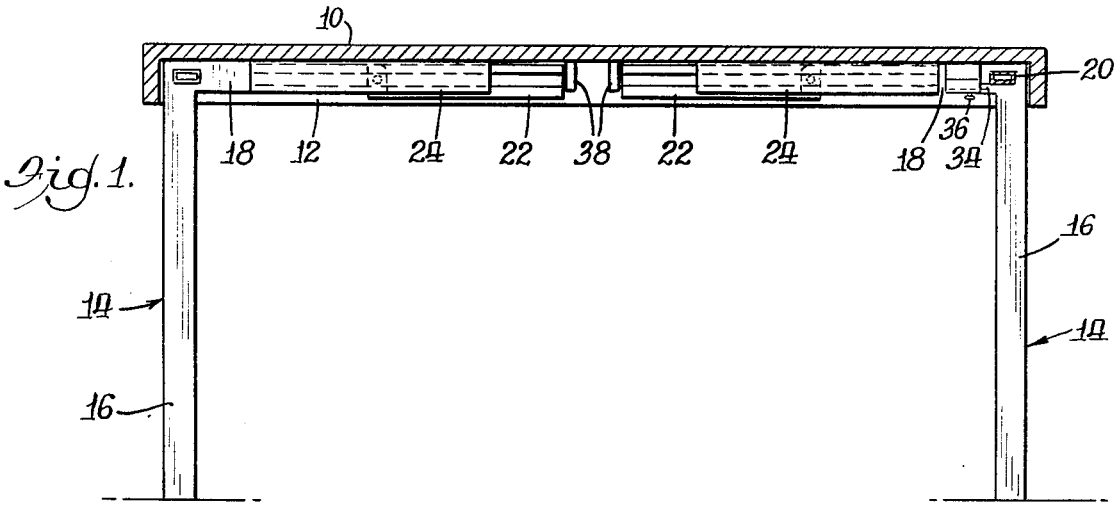
Fig. 1.
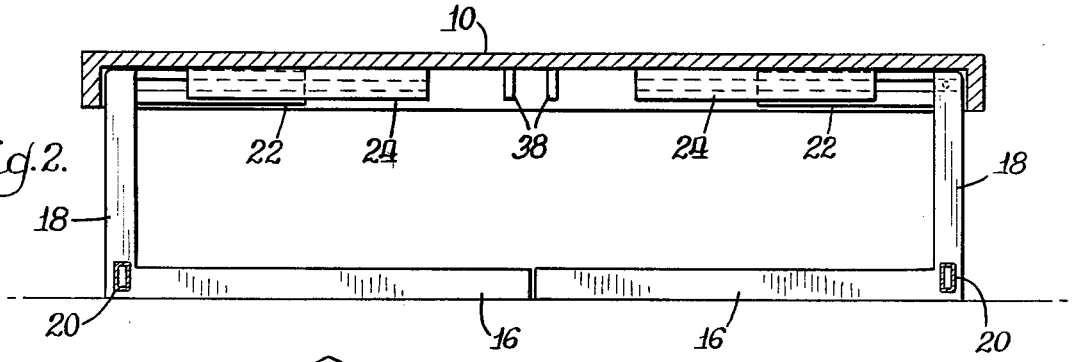
Fig. 2.
Fig. 5.
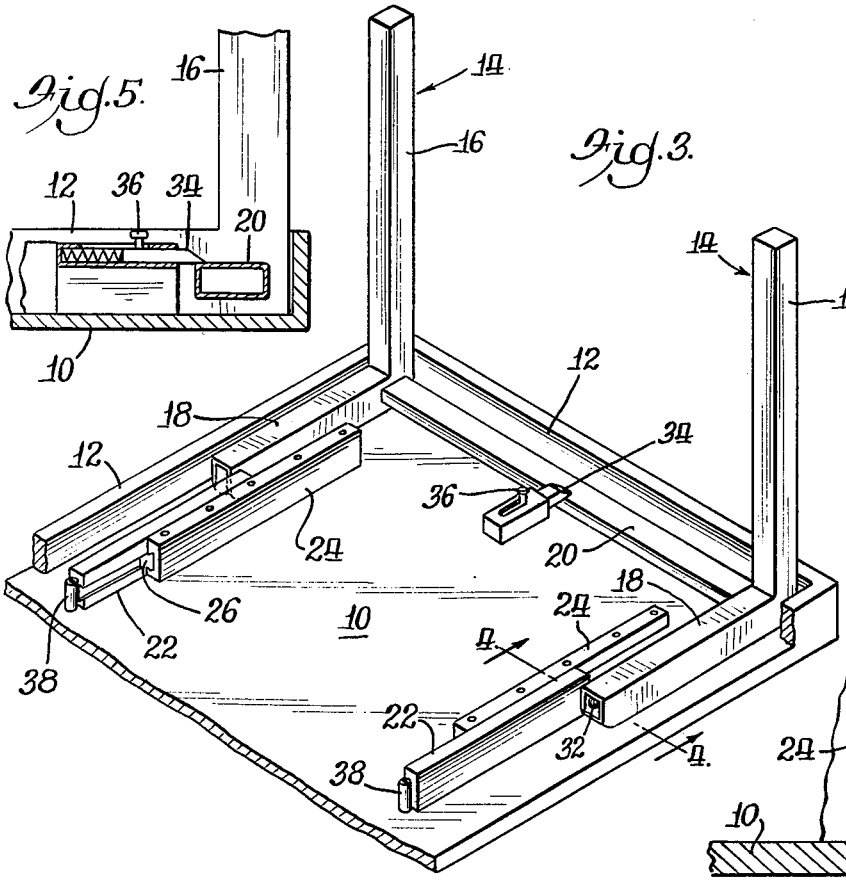
Fig. 3.
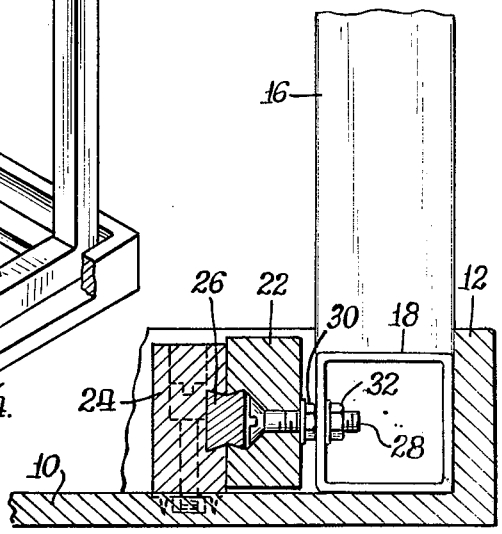
Fig. 4.

DUAL HEIGHT TABLE

This invention relates to tables which are adjustable selectively to two different heights to serve, for example, as dining tables at the greater height and as coffee or cocktail tables at the lesser.

As thus broadly characterized, such tables are not new, examples being found in the following United States patents, among others: U.S. Pat. Nos.

2,106,309; 2,635,023; 2,253,777; 2,636,794; 2,527,505; 2,666,681; 2,581,658; 2,688,524; 2,602,011; 2,843,437; 2,638,360; 3,087,442.

Typically, such tables may employ a cross-legged supporting structure, or a box or frame which can be reoriented selectively relative to the table top so as to support the top at at least two different levels above the floor. In one simple form, such dual height support structures are L-shaped leg members pivoted to the table top so that one or the other of two legs of unequal length can be assigned the task of supporting the table top.

The present invention is concerned with the association of such L-shaped leg members with a table top so as to achieve the dual height function in a manner which not only eases the adjustment of the table between its two positions, but also permits styling possibilities not heretofore realized.

A preferred form of table in accordance with the invention is illustrated in the accompanying drawings in which:

FIG. 1 is a sectional side elevational view of a table in accordance with the invention with the supporting leg members adjusted to place the table top at the greater height;

FIG. 2. is a corresponding side elevational view showing the table top adjusted to its lesser height;

FIG. 3 is a fragmentary isometric view of one end of the table top viewed from the underside and illustrating the leg members in an attitude relative to the table top which corresponds to the greater table height of FIG. 1;

FIG. 4 is a fragmentary sectional view taken along the line 4—4 of FIG. 3 to illustrate the movable attachment of the leg members to the table top for their adjustment from the position of FIG. 1 to that of FIG. 2, and vice versa; and FIG. 5 is an enlarged fragmentary elevation of the bolt, also seen in FIG. 3, which serves to secure the leg members in the attitude of FIGS. 1 and 3, i.e., for supporting the table top at its greater height.

The dual height table of the present invention differs from prior tables for similar purpose in the particular manner in which the L-shaped leg members thereof are joined to the table top.

In the illustrated case, the table top 10 comprises a single rectangular sheet or plate of any suitable material, such as wood or plastic, or combinations thereof, which is of such thickness that, when self-flanged or skirted, it exhibits sufficient structural integrity for a table of at least small dining table size. In the illustrated instance, the skirt or flange 12 around the edge of the table top also serves to screen the mechanism for the adjustable attachment of the leg members to the underside of the table top, but it will be appreciated presently that the relative organization of the components of this novel table is such as to be adaptable as well to design aesthetics in which the L-shaped leg members and their respective attachments to the table top are boldly exposed in all positions of the table.

The L-shaped leg members 14 which support the table are four in number, each comprising a long leg 16 for supporting the table at its greater height and a short leg 18 integrally connected thereto at right angles for supporting the table top at its lesser height. In the illustrated embodiment, the two leg members 14 at each end of the rectangular table leg are rigidly interconnected by a cross-member 20 which extends between the two short legs at their junctures with the long legs, and are pivotally connected at the distal ends of the short legs, and on a common axis, to slide members 22 on the underside of the table top. As shown, each pair of interconnected leg members is a weldment of metal tubes, suitably finished, as by plating.

The slide members 22, seen best in FIGS. 3 and 4, may comprise wood battens which are positioned side-by-side with similarly sized battens 24 screwed to the underside of the table top 10. The two battens, the one fixed and the other movable, are joined together in endwise sliding relationship by a double dovetail gib 26 received in dovetail slots milled in the mating longitudinal faces of the battens (see FIG. 4). The gib may be secured in one batten so as to be movable in the other.

The slide member 22 is further provided with a sidewardly extending bolt 28 countersunk below the dovetail slot of that member and maintained in stud-like projection by a first washer and nut 30 drawn up on the bolt, and also serving as spacers between the slide member 22 and the associated leg member 14. As shown in FIG. 4, the stud-like extension of the bolt 28 is passed through a hole in the wall of the leg member 14 at the distal end of the short leg 18, and secured thereto by a second washer and nut 32. In the illustrated arrangement, with the wall of the tubular leg member confined tightly between the two nuts, the relative rotation occurs silently between the steel bolt 28 and the wooden slide member 22.

In the position of FIGS. 1 and 3, the short legs 18 of the L-shaped members 14, and their interconnecting cross-member 20, are concealed by the skirt 12 of the table top, and, in that position, the cross-member 20 is engaged by a spring-loaded bolt 34 on the underside of the table top, which permits the table to be lifted and moved while standing at its greater height without dropping the pivoted leg members 14. As indicated in FIG. 5, the retaining bolt 34 is both beveled and spring-loaded so as to readily receive and secure the leg members in the FIGS. 1 and 3 position, but readily disengageable, by an appropriate thumb knob 36 secured to the bolt, to permit adjustment of the table.

Adjustment from the greater height of FIG. 1 to the lesser height of FIG. 2 is accomplished by reaching under the table to disengage the latch bolt 34, and lifting the table top while the latch bolt is disengaged. This permits the leg members 14 to swing downwardly by gravity, exposing the interconnecting cross-member 20 to the convenient grasp of the person making the adjustment, who pulls the leg members 14 toward him while permitting the table top to sink by gravity until its weight is borne by the short leg 18, i.e., until the long leg 16 engages the floor in what might be described as a "kneeling" attitude.

The operation is then repeated at the opposite end of the table, assuming adjustment by the same person, or may be performed simultaneously if two people are available. The lowered position is shown in FIG. 2, with all leg members 14 in the "kneeling" attitude.

Adjustment to the greater height is accomplished by the same sequence of movements in reverse. That is, the table top 10 is lifted at either or both ends, the cross-member 20 grasped and first pulled outwardly to erect the long legs 16. Then with the ends of the long legs resting on the floor, the cross-member is pushed inwardly to retract the short legs 18, the cross-member being recaptured by the latch bolt 34 in the final movement.

The inward movement of the slide member 22 is preferably limited to that necessary to accommodate the short leg 18 behind the skirt 12 at the end of the table, i.e., through a distance essentially equivalent to the length of the short leg, the inward movement of each slide member being thus restrained by a stop post 38 secured to the underside of the table top.

From the foregoing description of the structure and its operation, it will be apparent that the sliding pivotal attachment of the opposed leg members to the table top at opposite ends serves a particular purpose, namely, to accommodate the placement of the long legs of the L-shaped leg structure in endwise abutting relation on the floor in a table of minimal length, i.e., one whose length is only twice the height of the table at dining height. Secondarily, it provides for uniform spacing of the table legs at both adjusted heights of the table.

In its broader aspects, however, and for situations where space and size limitations are not controlling, or where design requirements might permit the longer legs of the table to be overlapped or interleaved, the pivotal attachment of the leg structures to the table top may be fixed rather than movable.

It will also be apparent that the sliding pivotal connection of the leg structures to the table top of the preferred illustrated embodiment may be replaced by other displaceable pivotal connections, for example links, to provide for the shifting of the pivot of the leg member between its two positions on the underside of the table.

Perhaps equally obvious is that whereas the four separate L-shaped leg members of the preferred form provide a distinct supporting leg at each corner of the table when adjusted to dining height, even though rigidly interconnected as pairs for convenience of adjustment, the interconnected pairs may also take the form of a single L-shaped pedestal-like structure of adequate floor-engaging width, provided either that the structure is sufficiently open to receive the knees of persons seated at the end of the table for dining or that the table top be provided with sufficient overhang for the same purpose.

Features of the invention believed new and patentable are set forth in the appended claims.

What is claimed is:

1. In a table having a table top supported on L-shaped leg members which are movably connected to the table top to support the table top selectively at one of two heights above a floor by standing the table top either on the long or the short legs of said leg members, the improvement comprising the pivotal connection of the leg members to the table top at the distal ends of the short legs with said leg members oriented so that the short legs extend inwardly of the table when the table is supported by the long legs, and the long legs extend inwardly of the table when the table is supported by the short legs, slide members secured to the underside of the table top and having said pivotal connections secured thereto for sliding movement therewith, said pivotal connections of the leg members to the table top being movable along the underside of the table top to alter the distance between the pivot axes of opposed leg members at least to the extent necessary to provide the same spacing of the supporting legs at both heights of the table top, said legs being four in number arranged in two opposing pairs, said pivotal connections being located at inward positions with said short legs abutting the underside of said table top when the table is supported by said long legs to provide stability to said table, said pivotal connections being moved from said inward positions to adjacent the table end when the table is supported by the short legs, said short legs and said long legs each being located at corners of the table top when supporting the table, said long legs being aligned and abutting the floor when the table is positioned at the lower height.

2. The improvement of claim 1 wherein the leg members are connected to the table top as opposed pairs with the corresponding idle legs of said pairs extending toward each other when the table top is supported by the other legs of each pair.

3. The improvement of claim 2 wherein the two leg members are parallel to each other, are rigidly interconnected for movement in unison, and are pivoted to the table top on a common axis which is parallel to the corresponding pivot axis of the opposed pair, and the pivotal connection of each pair to the table top is movable through a distance at least as great as the length of the short legs so that the spacing of the supporting legs is uniform at both table heights, the long legs of the opposed pairs of leg members being aligned with and abutting each other on the floor when the table is positioned at the lower height.

4. The improvement of claim 1 in which a cross member joins together two short legs at their respective junctures with their long legs, and a detent means on said table has detenting engagement with said cross member when said long legs support the table.

* * * * *